US008381341B2

(12) United States Patent
Nieh et al.

(10) Patent No.: US 8,381,341 B2
(45) Date of Patent: Feb. 26, 2013

(54) METHOD AND APPARATUS FOR DETERMINING LOAD SIZE IN A WASHING MACHINE

(75) Inventors: Jenn-Yeu Nieh, Saint Joseph, MI (US); James Andrew Oskins, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 781 days.

(21) Appl. No.: 12/209,466

(22) Filed: Sep. 12, 2008

(65) Prior Publication Data

US 2010/0064445 A1 Mar. 18, 2010

(51) Int. Cl.
*D06F 35/00* (2006.01)

(52) U.S. Cl. ..... 8/158; 8/159

(58) Field of Classification Search ..... None
See application file for complete search history.

(56) References Cited

U.S. PATENT DOCUMENTS

| | | | |
|---|---|---|---|
| 6,634,191 | B1 | 10/2003 | Guler et al. |
| 2005/0022564 | A1 | 2/2005 | Kim et al. |
| 2008/0028801 | A1 | 2/2008 | Czyzewski et al. |

FOREIGN PATENT DOCUMENTS

| | | | |
|---|---|---|---|
| DE | 4122307 | A1 | 1/1993 |
| EP | 0649932 | A1 | 4/1995 |
| EP | 0787848 | A1 | 8/1997 |
| JP | 01178292 | A | 7/1989 |
| WO | 2007/003593 | A1 | 1/2007 |

*Primary Examiner* — Michael Barr
*Assistant Examiner* — Jason Ko
(74) *Attorney, Agent, or Firm* — Clifton G. Green; McGarry Bair PC

(57) ABSTRACT

A method and apparatus according to one embodiment for determining laundry load size in an automatic clothes washer includes supplying water to predetermined water levels higher than a saturate water level and determining the amount of water supplied to reach each predetermined water level from a prior water level, and determining a load size based on the determined amount of water supplied between the current predetermined water level and the prior water level.

36 Claims, 8 Drawing Sheets

METHOD AND APPARATUS FOR DETERMINING LOAD SIZE IN A WASHING MACHINE

BACKGROUND OF THE INVENTION

For a wash process of a washing machine, the water level in the tub may be set based on the size of a laundry load and, sometimes, the fabric type of the laundry load, if this information is available. From a cost of the washing machine perspective, it is better to have the user manually input the laundry load information through a user interface; although from the perspective of convenience to the user, it may be desirable to have the washing machine automatically determine the information. From an accuracy perspective, manual input by the user often is a greater source of error because the user may often overestimate or underestimate the load size, thereby resulting in too much or too little water, respectively, for the wash process. Too much water is wasteful, and too little water may lead to an insufficient wash performance and/or other negative implications. Users have also been known to forget to enter the information. The automatic determination by the machine is often more consistent and accurate than the manual entry by the user.

Many methods are known for the washing machine to automatically determine the load size and/or fabric type, such as by employing an output of the motor that drives the drum within the tub and the agitator within the drum. However, these systems depend on additional motor sensors, such as motor torque, and the associated hardware, such as multiple or variable speed motors, and their electronics, such as the motor controller, which naturally increase the cost of the machine. These associated additional costs are often unacceptable, especially in machines that use single speed motors and simple controls. Therefore, many machines have motors that do not provide output useful for determining load size or have other limitations that preclude or make undesirable known methods for automatically determining load size.

SUMMARY OF THE INVENTION

A method and apparatus according to one embodiment of the invention for determining laundry load size in an automatic clothes washer by supplying water to predetermined water levels higher than a saturate water level and determining the amount of water supplied to reach each predetermined water level from a prior water level, and determining at each predetermined water level a load size based on the determined amount of water supplied between the current predetermined water level and the prior water level.

DESCRIPTION OF EMBODIMENTS OF THE INVENTION

Figure 1:
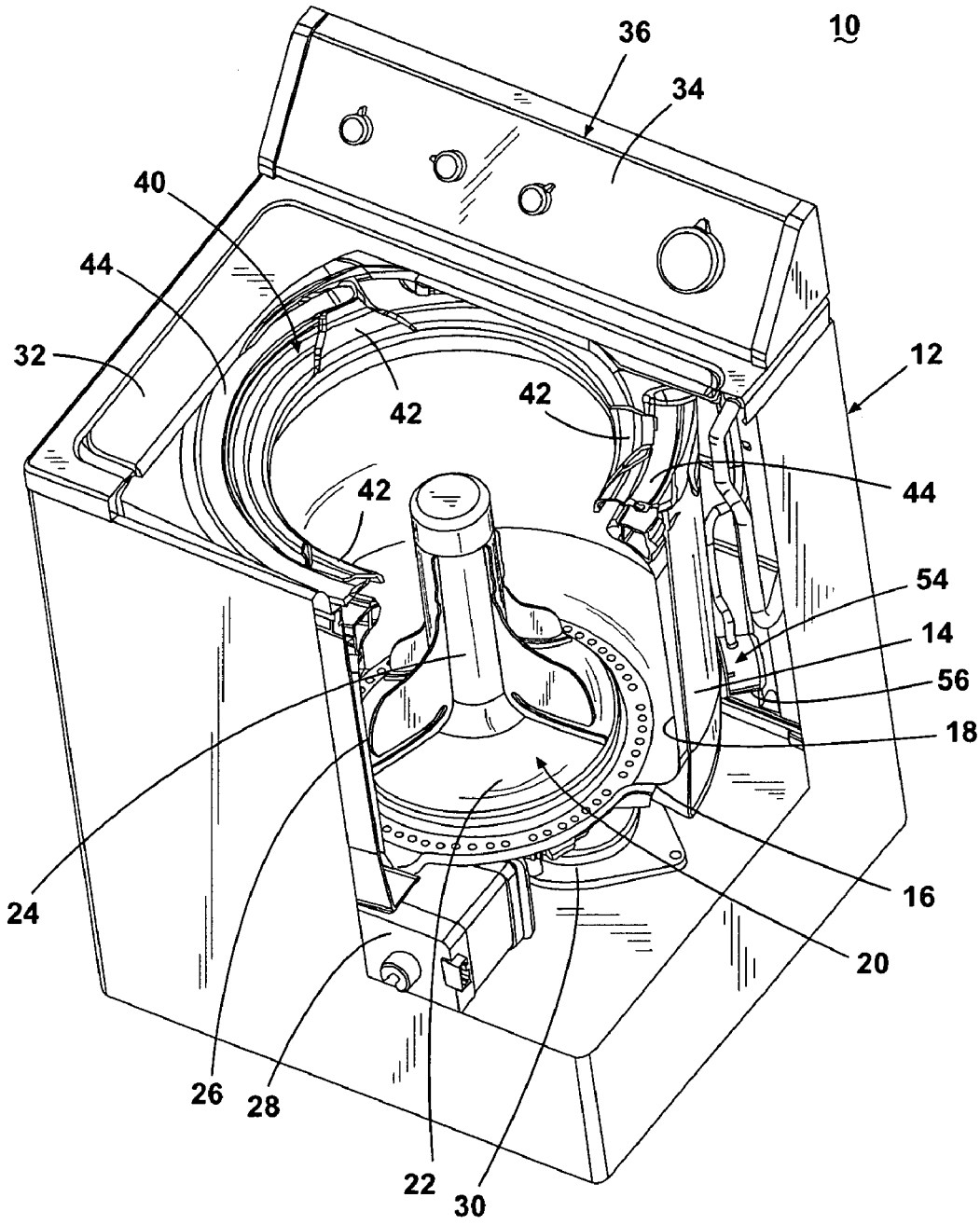
FIG. 1 is a front-top perspective view of an exemplary washing machine according to one embodiment of the invention with a portion cut-away to show interior components of the washing machine.

Referring now to the figures, FIG. 1 is a schematic view of an exemplary washing machine 10 according to one embodiment of the invention. The methods described herein may be used with any suitable washing machine and are not limited to use with the washing machine 10 described below and shown in the drawings. The washing machine 10 is described and shown for illustrative purposes. While the washing machine 10 is a top-fill washing machine having a vertical axis of rotation, the invention may have applicability in washing machines with different water filling systems, such as bottom-fill or indirect water filling systems, and a different axis of rotation, such as a horizontal axis of rotation or a rotational axis between horizontal and vertical.

The washing machine 10 may include a cabinet or housing 12, an imperforate tub 14 having a sump 16, a perforated basket or drum 18 mounted within and rotatable relative to the tub 14 and defining a laundry chamber for receiving a laundry load, and an agitator 20 mounted within and rotatable relative to and/or with the drum 18. The exemplary agitator 20 may have a lower circular base or skirt portion 22, a central shaft 24 extend 24 with the lower edge of each blade 26 spaced above the base 22. A variety of other designs for the agitator 20 may also be used, or the agitator 20 may be omitted altogether without affecting the scope of the invention. The drum 18 and/or the agitator 20 may be driven by an electrical motor 28 operably connected via an optional transmission 30 to the drum 18 and/or the agitator 20. The transmission 30 may be a gear driven direct drive. The motor may be an induction motor, which may be coupled to a transmission 30. Other motors, such as brushless permanent magnet (BPM) or a permanent split capacitor (PSC) motor may also be used. Similarly, drive systems other than a transmission 30 may be used, illustrative examples of which include direct drives or belt drives. A selectively openable lid 32 may be provided on the top of the cabinet 12 to provide access into the drum 18 through the open top of the drum 18. A user interface 34, which may be located on a console 36, may include one or more knobs, switches, displays, and the like for communicating with the user, such as to receive input and provide output.

A spraying system 40 may be provided to spray liquid, such as water or a combination of water and one or more wash aids, such as detergent, into the open top of the drum 18 and onto the top of any fabric or laundry load placed within the drum 18. The spraying system 40 may be configured to supply water directly from a household water supply and/or from the tub 14 and spray it onto the laundry load. The spraying system 40 may also be configured to recirculate liquid from the tub 14, including the sump 16 in the tub 14, and spray it onto the top of the laundry load. Other embodiments of the invention may use other water delivery techniques known to those skilled in the art. As used herein, the terms water and liquid are interchangeable and may refer to water or a combination of water and wash aid, including detergents, bleaches, and other wash or rinse aids.

As illustrated, the spraying system 40 may have one or more spray heads 42 directed into the open top of the drum 18. A liquid supply line (not shown) supplies liquid to a distribution manifold 44 integrated with the balancing ring to effect the supply of liquid to the spray heads 42, although other delivery configurations could also be used. The supply line may be fluidly coupled to either or both of the household water supply or the tub 14 as previously described. When liquid is supplied to the supply line from either the household supply or the tub 14, the liquid may be directed to the spray heads 42 through the manifold 44 and then be emitted through the spray heads 42 into the open top of the drum 18 and onto any laundry load in the drum 18.

If, for example, the number, location, and coverage of the spray heads 42 is insufficient to substantially cover the drum 18, the drum 18 may be rotated so that the laundry load is rotated beneath the spray heads 42 for a more even wetting. However, the number of spray heads 42 and their location may be selected to control their spray coverage such that they sufficiently evenly wet the laundry load in the drum 18 without the need for rotating the drum 18, which likely reduces the cost and complexity of the motor 28, transmission 30, and controller 56.

Figure 2:
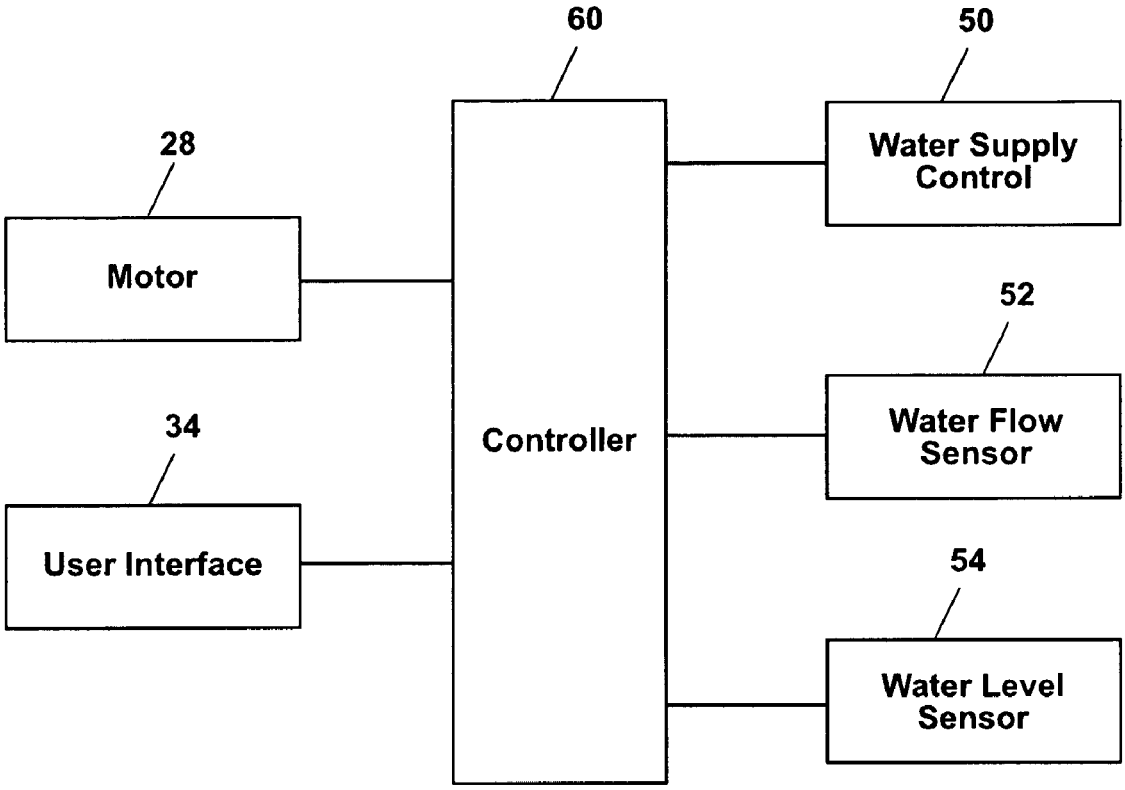
FIG. 2 is a schematic view of a control system for the washing machine of FIG. 1 according to one embodiment of the invention.

Referring now to FIG. 2, in one embodiment of the invention, the washing machine 10 further includes a water supply control 50, a water flow sensor 52, and a water level sensor 54. The water supply control 50 may include one or more valves, pumps, and/or other flow control devices operable to selectively fluidly communicate an external water supply (not shown) with the tub 14 or the spraying system 40. The water flow sensor 52 may be employed to measure the amount of water supplied to the tub 14, including water supplied via the spraying system 40. The water flow sensor 52 may measure the amount of supplied water directly, such as a flow meter, or indirectly, such as by monitoring the open and closed durations of one or more water valves or other the operation of other devices in the water supply control 50.

When the water supply control 50 controls the supply of water to the tub 14, the level of water in the tub 14 may be detected by the water level sensor 54, which may be positioned in any suitable location for detection of the water level in the tub 14. The water level sensor 54 may be any suitable type of water level sensor, such as a pressure sensor, including a dome-type pressure sensor or a float-type sensor, as is well-known in the art and illustrated in the drawings.

Figure 3B:
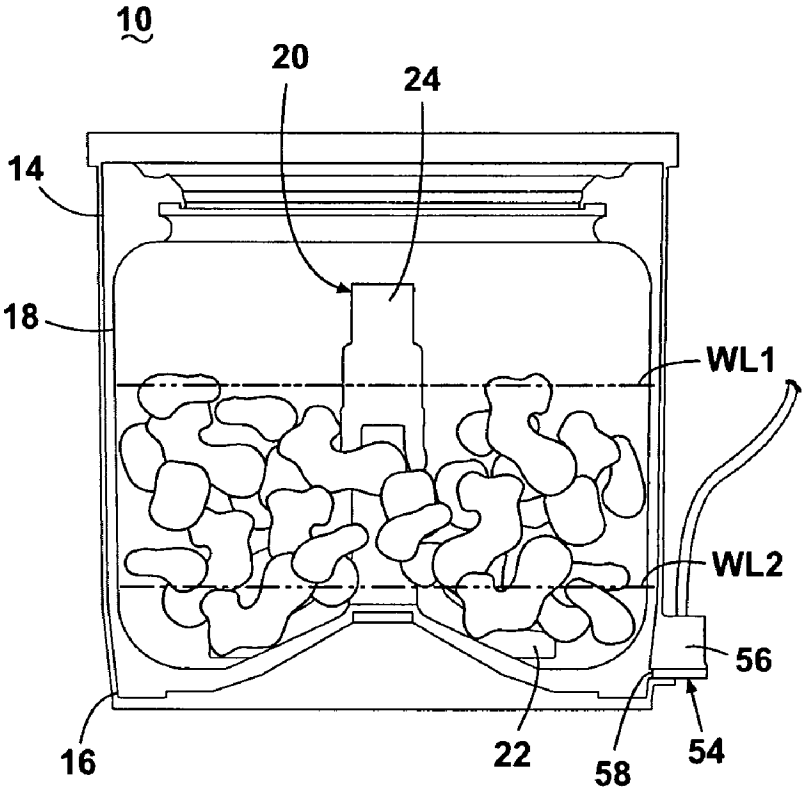
FIGS. 3A and 3B are schematic views of the washing machine of FIG. 1 illustrating relative density of a relatively smaller laundry load (FIG. 3A) and a relatively larger laundry load (FIG. 3B) in a mixture of the laundry load and water in a water level window defined between lower and upper water levels according to one embodiment of the invention.
Figure 3A:
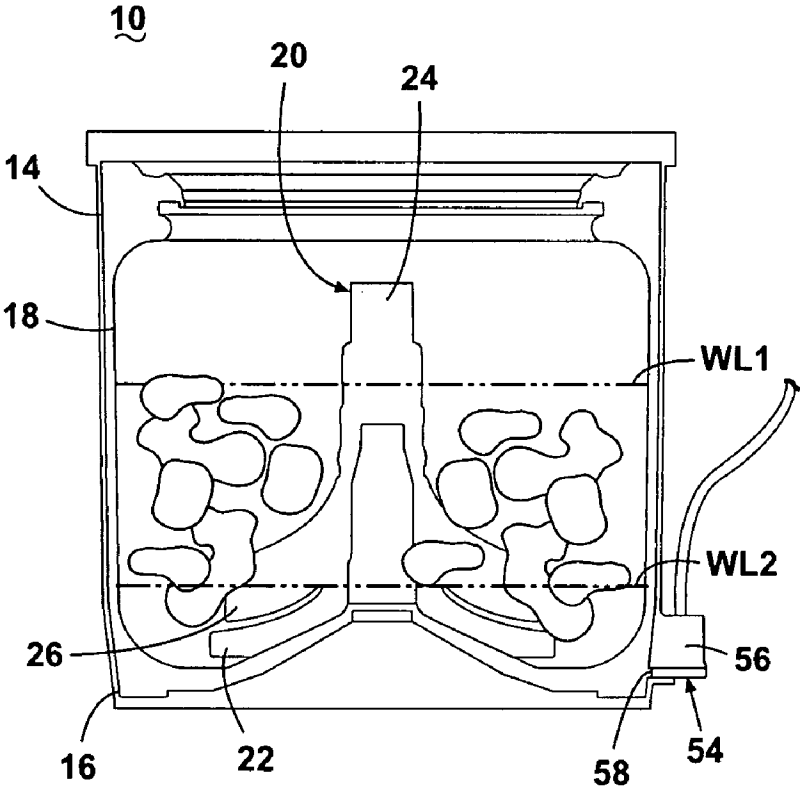

In the embodiment illustrated in FIG. 1, the water level sensor 54 is positioned adjacent to the sump 16 of the tub 14. In particular, as best seen in FIG. 3A or 3B, which are schematic views of the washing machine tub 14, drum 18, agitator 20, and water level sensor 54 of FIG. 1, the water level sensor 54 may be a dome-type pressure sensor including a housing 56 mounted to the outside of the tub 14 and fluidly coupled with the inside of the tub 14, particularly the sump 16, through an opening or inlet 58. Water from the inside of the tub 14 is exposed to the water level sensor 54 through the inlet 58 into the housing 56. The water level sensor 54 "sees" the pressure associated with the water in the tub acting at the inlet 58, as is well-known in the art. Thus, the water level in the tub 14 must be at least as high as the inlet 58 for the water level sensor 54 to be able to detect the presence of water in the tub 14, which will be described in more detail below.

Referring back to FIG. 2, a controller 60 communicates with several working components and/or sensors in the washing machine 10, such as the motor 28, the user interface 34, the water supply control 50, the water flow sensor 52, and the water level sensor 54, to receive data from one or more of the working components or sensors and may provide commands, which may be based on the received data, to one or more of the working components to execute a desired operation of the washing machine 10. The commands may be data and/or an electrical signal without data. Many known types of controllers may be used for the controller 38. The specific type of controller is not germane to the invention.

The washing machine 10 shown in the figures and described herein is a vertical axis washing machine. As used herein, the "vertical axis" washing machine refers to a washing machine having a rotatable drum that rotates about a generally vertical axis relative to a surface that supports the washing machine. However, the rotational axis need not be vertical; the drum may rotate about an axis inclined relative to the vertical axis. Typically, the drum is perforate or imperforate and holds fabric items and a fabric moving element, such as an agitator, impeller, pulsator, infuser, nutator, and ribbing or baffles on the interior wall of the basket or drum, and the like, that induces movement of the fabric items to impart mechanical energy directly to the fabric articles or indirectly through wash water in the drum for cleaning action. The clothes mover is typically moved in a reciprocating rotational movement, although non-reciprocating movement is also possible.

Although the washing machine 10 is a vertical axis washing machine, the methods described below may be employed in any suitable washing machine having a fabric moving element, including washing machines other than vertical axis washing machines. As used herein, "agitator" refers to any type of fabric moving element and is not limited to the structure commonly associated with an agitator, such as the structure shown in FIG. 1. Similarly, "agitate" refers to moving the fabric items and/or the water, regardless of the type of fabric mover inducing the movement of the fabric items and the type of motion of the fabric mover to induce the movement.

A washing machine may perform one or more manual or automatic operation cycles, and a common operation cycle includes a wash process, a rinse process, and a spin extraction process. Other processes for operation cycles include, but are not limited to, intermediate extraction processes, such as between the wash and rinse processes, and a pre-wash process preceding the wash process, and some operation cycles include only a select one or more of these exemplary processes. Regardless of the processes employed in the operation cycle, the methods described below may relate to determining a size of the laundry load for a process in the operation cycle.

As illustrated, the motor 28 and transmission 30 shown in FIG. 1, while economical and functional, are typically not capable of more advanced load size determination methodologies, such as inertia determination based on motor torque data obtained from the motor current. The motor control often provides for only a single speed of operation for the motor 28. There may be mechanical noise from the clutch and brake that would interfere with such a control. There may not be feedback from the motor power signal. The drain pump may also be driven by the motor 28, which will cause pump draining when the drum is spun. For this type of configuration, other load size methods may be needed, especially something other than relying on the motor torque signal.

Figure 4A:
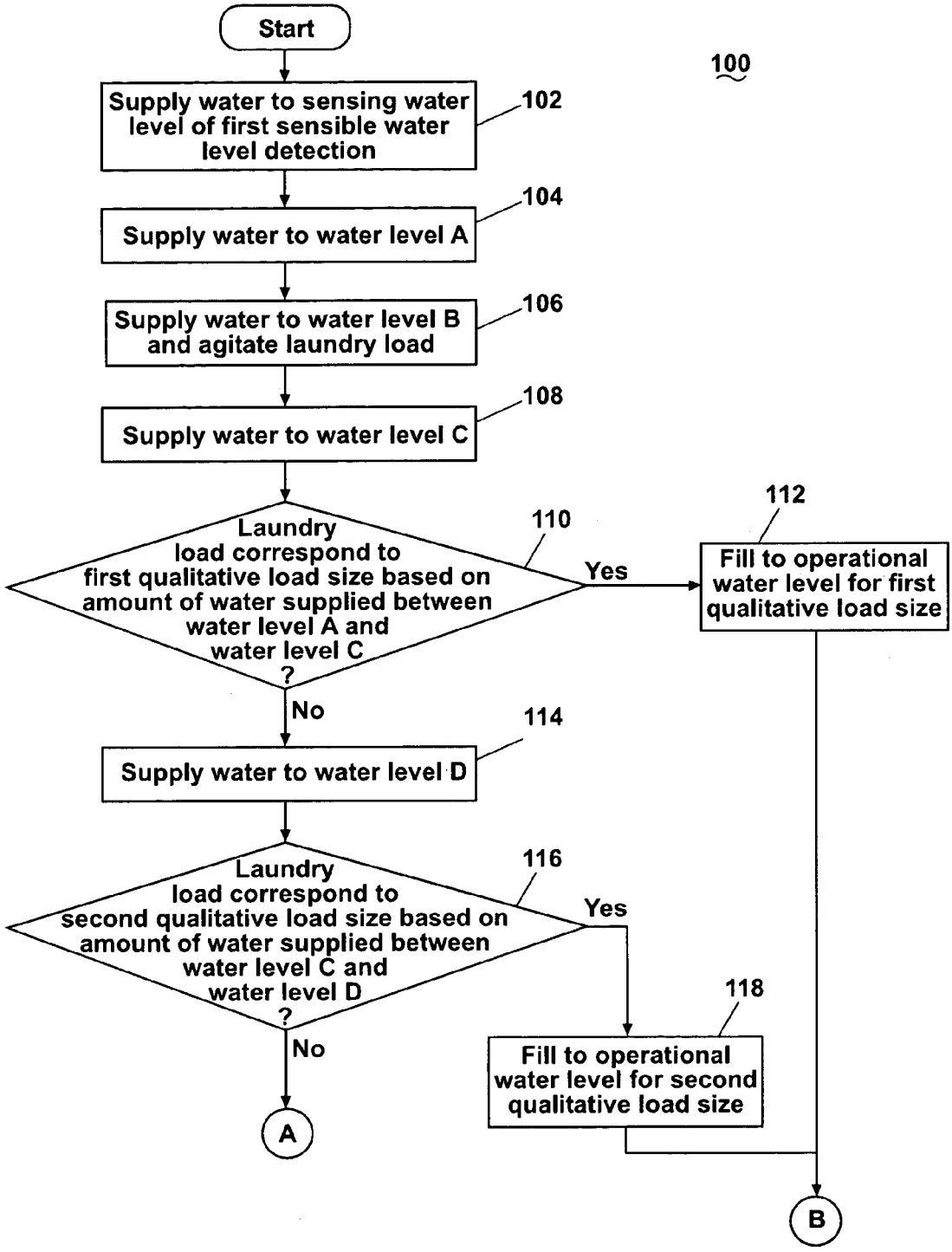
FIGS. 4A and 4B are an exemplary flow chart of a method for determining load size in the washing machine of FIG. 1 according to one embodiment of the invention.
Figure 4B:
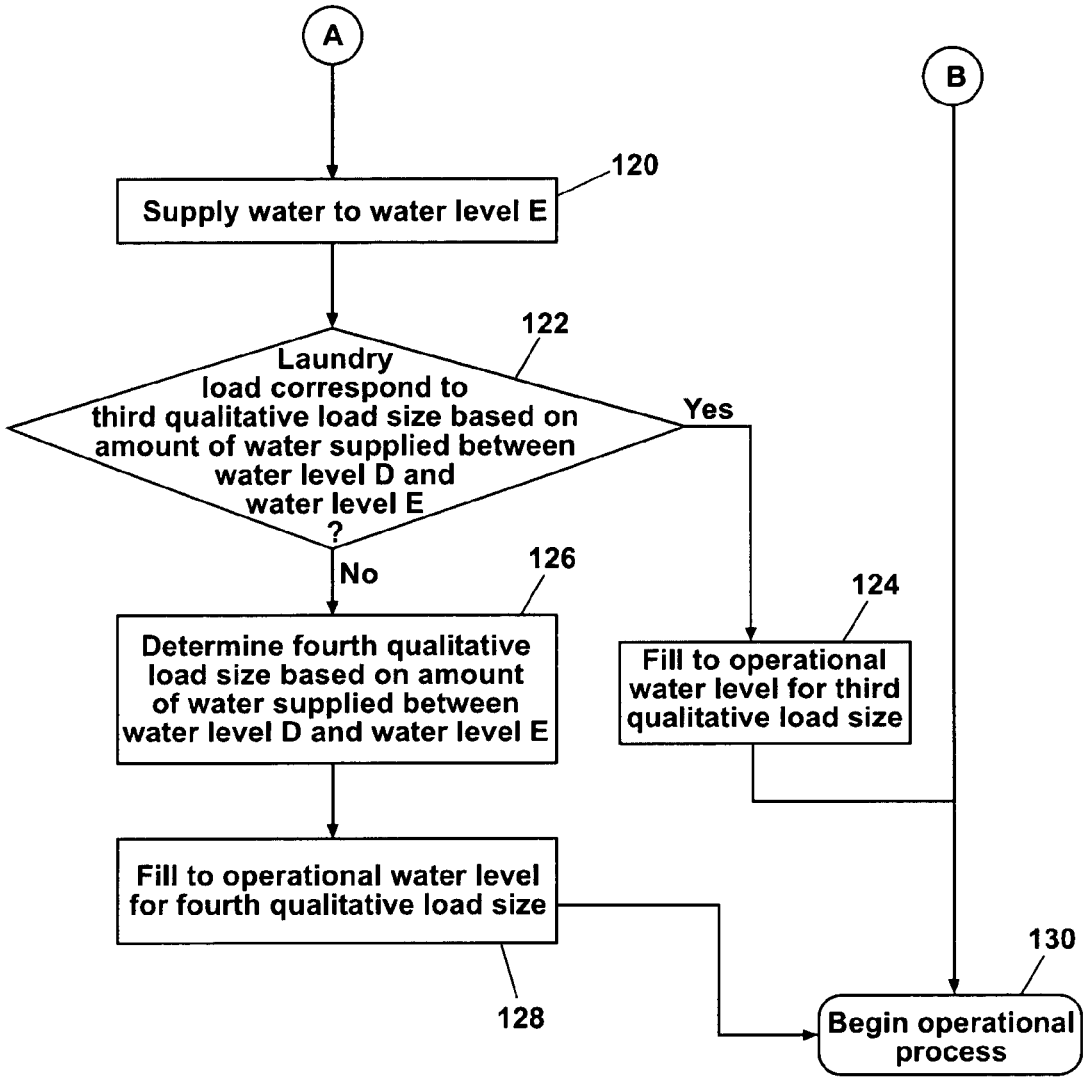

FIGS. 4A and 4B provide a flow chart corresponding to a method 100 of operating the washing machine 10 according to one embodiment of the invention. The method 100 may be implemented in any suitable manner, such as in an automatic or manual operation cycle of the washing machine 10. The method 100 may be conducted as part of a wash process or other suitable process, such as a pre-wash or rinse process, of the operation cycle. Regardless of the implementation of the method 100, the method 100 may be employed to determine a size of the laundry load for the associated process, which will be described as the wash process hereinafter for illustrative purposes.

In general, the method 100 may employ the water level sensor 54 and the water flow sensor 52 (FIG. 2) during supply of water to the tub 14 to determine laundry load size. The water supply control 50 supplies water to predetermined water levels in the tub 14, which may be detected by the water level sensor 54, and the water flow sensor 52 determines the amount of water actually supplied to the tub 14 to reach the predetermined water levels. The amounts of water supplied to reach each of the predetermined water levels may be employed to determine the laundry load size. According to one embodiment of the invention, the predetermined water levels may be selected according to water absorption and displacement behavior of the laundry load, as will be described in more detail below.

The flow chart in FIGS. 4A and 4B provides an overview of the method 100 according to one embodiment of the invention. The steps illustrated in FIGS. 4A and 4B illustrate one manner in which the method 100 may be implemented. For purposes of the invention, it is possible to have more or fewer steps, to combines steps, or have a different arrangement of the steps. Therefore, the specific steps and their sequence should not be considered limiting on the invention.

Prior to examining the specific steps in the exemplary method 100, the general approach of the method will be described for ease of understanding the specific example. The method 100 determines a qualitative or relative load size based on the amount of supplied water required to reach given water levels in the tub 14 (FIG. 1). The amount of water supplied to reach a given water level at initial stages of water supply depends on the absorbency of the laundry load. Because the laundry load absorbs at least some of the supplied water before the laundry load is saturated, the water supplied to reach a given water level includes water absorbed by the laundry load along with free water, i.e., the water not absorbed by the clothes and filling space in the tub 14 not occupied by the laundry load.

Determining load size during water supply before the laundry is saturated may be difficult due to different water absorption characteristics of differing fabric types. For example, cottons will absorb more water than most synthetics. For a load of a single fabric type, all other things being equal, a larger laundry load will typically absorb more water than a smaller laundry load.

The supplied water rarely results in a corresponding increase in the water level, that is, a one-to-one relationship between volume of supplied water and volumetric increase of the water level in the tub 14, until the clothes load is fully saturated and any interstitial spaces between the clothes items are filled with water. In most cases, however, the absorbency has a greater effect on the lack of a one-to-one relationship than the interstitial spaces. Therefore, for most practical applications, only the saturation need be taken into account, while ignoring the effects of the interstitial spaces.

Once the laundry load is fully saturated, more of the water supplied to the tub 14 becomes free water in the tub 14. Because the laundry load is saturated, the amount or volume of water supplied to the tub 14 between given water levels (above the water level at which the laundry load is saturated) equals the volume of the tub 14 between the given water levels less the volume of the laundry load between the given water levels; therefore the amount of water supplied to fill the tub 14 between the given water levels is indicative of the load size, regardless of the type or absorbency of the fabrics in the laundry load.

This concept is illustrated in FIGS. 3A and 3B, which are schematic views of the washing machine in FIG. 1 having laundry loads with differing load sizes. The tub 14 in FIG. 3A contains a laundry load smaller than the laundry load in the tub 14 of FIG. 3B. The saturated smaller load occupies less space in the region between given water levels WL1 and WL2, and, thus, requires more water to fill the region than required by the saturated larger load. Displacement refers to the physical space occupied by the laundry load (rather than the water) below the actual water level. A larger laundry load takes up more space than a smaller laundry load and displaces more water; therefore, a larger laundry load requires less water than a smaller laundry load to reach a given water level once the laundry is saturated. The displacement caused by the laundry load, accordingly, may be employed as an indicator of load size. Another way to consider this concept is that the relative density of the mixture of water and the smaller laundry load between the given water levels is less (i.e., more water and less laundry load) than the relative density for the mixture of water and the larger laundry load (i.e., less water and more laundry load).

The region between WL1 and WL2 may be thought of as a window with the water levels WL1 and WL2 setting the upper and lower boundaries. In this application, a size of the window may be varied by looking at different water levels relative to a fixed reference water level or a moving reference water level. One embodiment applies the window with a moving reference water level and determines an indicator of the relative density in the window, which may be thought of as a transient density. As more water is supplied and the window moves upward in the tub 14, the transient density may approach the density of the supplied water. At some point, which may be before, during, or after the transient density reaches the density of the supplied water, the transient density may indicate a laundry load size based on empirical data for similar loads. The laundry load size may then be determined, and the information may be used in setting applicable parameters for an operation cycle or particular process of an operation cycle.

The method 100 may employ the behavior of the laundry load prior to and following saturation during water supply to determine load size. During the initial stages of water supply, as stated above, the supplied water is partially absorbed by the laundry load and partially becomes free water in the tub 14. While it may be difficult to determine all load sizes due to the issues associated with absorbency of the laundry load discussed above, extreme load sizes, such as extra small and extra large load sizes, may be determined because their absorbency and displacement behavior is correspondingly extreme, as will be described in more detail below. Load sizes of laundry loads between the extreme load sizes may be determined by using the displacement behavior of the laundry load, or the relative density of the mixture of the laundry load and free water, after saturation occurs.

Returning again to FIG. 4A, the exemplary method 100 begins with a step 102 of supplying water to the tub 14, such as via the spraying system 40, to a sensing water level S, which may be a level of water corresponding to a first sensible or meaningful water level that can be sensed by the water level sensor 54. The water level S, along with other water levels employed in the method 100, are illustrated by example in FIG. 5, which is a schematic view of the washing machine from FIG. 1 according to one embodiment of the invention. The remainder of the description of the method 100 will be understood to refer to FIGS. 4A, 4B, and 5, and reference to other figures will be included where appropriate.

Figure 5:
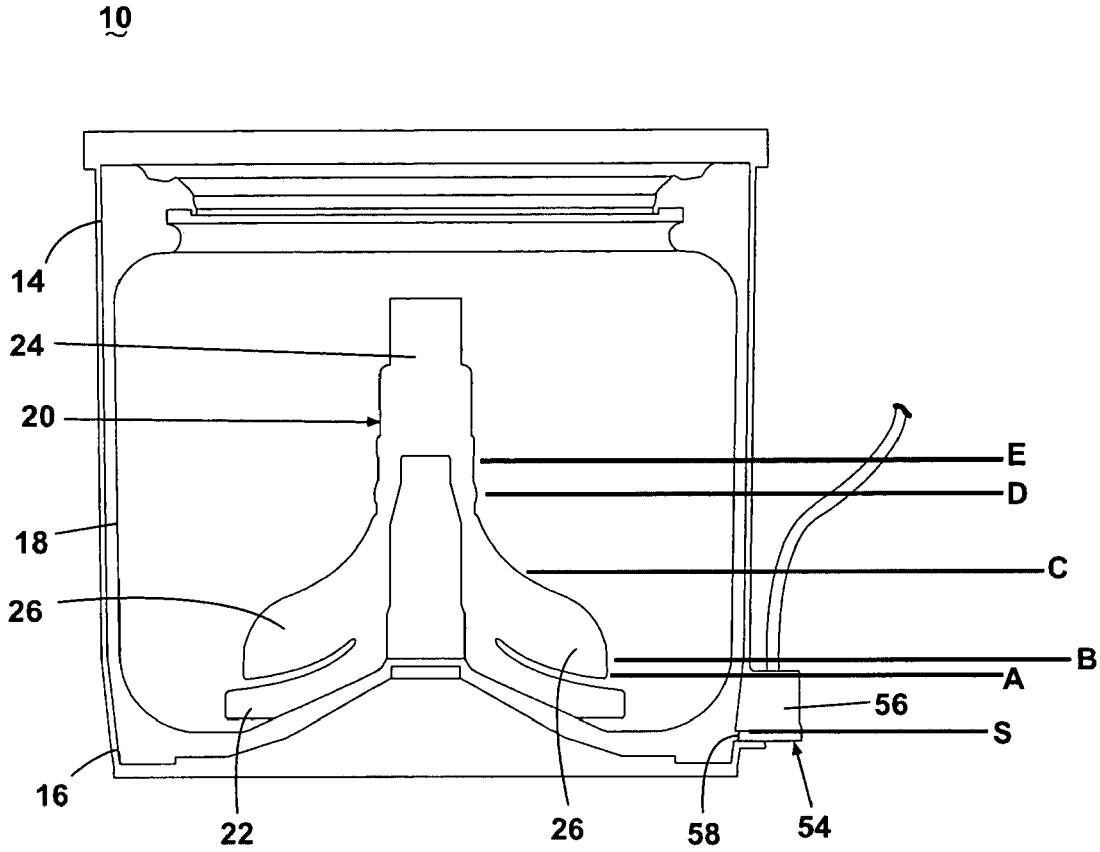
FIG. 5 is a schematic view of the washing machine of FIG. 1 illustrating exemplary water levels S, A, B, C, D, and E according to one embodiment of the invention.

In the configuration of washing machine 10 of FIG. 5, the water level sensor 54 is typically unable to detect a water level for water present in the tub 14 below the inlet 58 to the water level sensor 54; therefore, if not already present, water must be supplied to at least the inlet 58 before the water level sensor 54 can determine the water level. Thus, the actual water level corresponding to the sensing water level S may vary depending on the washing machine configuration and the type and location of the water level sensor 54 and may even vary for different operational cycles on the same washing machine. In the configuration of the washing machine 10 in the figures, the sensing water level S is a water level positioned in the sump 16 of the tub 14 at or above the inlet 58 to the water level sensor 54, as illustrated in FIG. 5.

Referring back to FIG. 4A, once the water reaches the sensing water level S, the water level sensor 54 is able to detect the water level in the tub 14, and the water supply continues at a step 104 to a water level A. The water level A may be used in part for determination of the load size and will be discussed in more detail below. The water supply during the steps 102 and 104 may be continuous, or a pause may occur between the supply of water in the steps 102 and 104 such that the water supplies are discrete, which may be true for all water supply steps in the method 100.

The water level A is at least higher than the sensing water level S and may be a water level sufficiently high such that the sump 16 is full. In the illustrated embodiment of FIG. 5, the water level A may be located above the base 22 of the agitator 20 and at or below the bottom of the agitator blades 26.

Referring to FIG. 4A, optionally, the method 100 may also include an overflow protection process whereby the amount of water added during the water supply may be compared to a preset overflow water amount; if the amount of water reaches the overflow water amount without a corresponding detection of water level by the water level sensor 54, then the controller 60 may assume that an error has occurred, such as an error of the water flow sensor 54 (FIG. 2), and cease water supply. The overflow protection process may occur at any time, including before or after the supply of water to the water level A.

After the supply of water to the water level A, water is supplied during a step 106 to a water level B, which may be any desired water level at or above the water level A. The water supply during the steps 104 and 106 may be continuous, or a pause may occur between the supply of water in the steps 104 and 106 such that the water supplies are discrete. Upon reaching the water level B, the agitator 20 may rotate to agitate and move the laundry load in the drum 18. In one exemplary embodiment, the water level B may be just above, such as a few millimeters, the water level A, (FIG. 5). The agitation may occur for any desired duration and may include rotation of the agitator in one or two directions at any suitable speed and frequency, such as the speed and frequency used in a normal wash process. As an example, the agitation may occur for about 5 seconds; in another embodiment, the agitation may occur for about 10-30 seconds.

Figure 6:
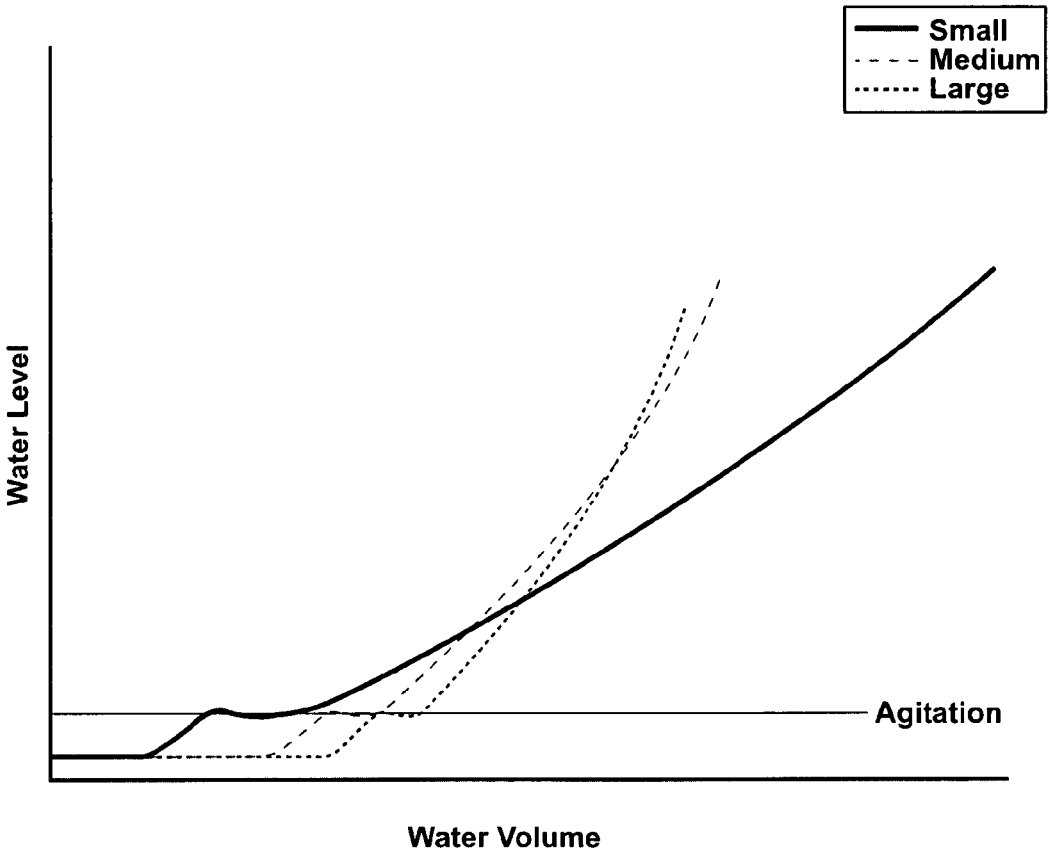
FIG. 6 is a schematic illustration of water level as a function of water volume during water supply and showing the effect of agitation on water level according to the embodiment of FIGS. 4A and 4B.

Agitation of the laundry load typically facilitates a more even distribution of the individual fabric items in the laundry load. As the laundry moves in the drum 18, larger loads may be brought or pulled down into the water rather than forming a pile in the drum 18. The agitation helps to reduce variation by moving the fabric items to a more repeatable position. As shown in FIG. 6, which is a schematic graph of water level as a function of water volume for small, medium, and large load sizes, the water level typically undergoes a slight change during the agitation of the laundry load. The water level may rise slightly at the beginning of agitation before decreasing near the end of agitation. The initial rise may be due to the laundry load being pulled down into the water, thereby displacing the water level upward, and the subsequent decrease may result from the laundry load being distributed or spread throughout the bottom of the drum 18 and/or release of entrapped air in the laundry load.

Agitation may be accomplished by processes other than or in addition to rotation of the agitator 20. For example, agitation may be facilitated by rotation of the drum 18 in a vertical axis washing machine. In other types of washing machines, such as a horizontal axis washing machine, which typically lacks an agitator, agitation may be accomplished by rotation of the drum.

Referring back to FIG. 4A, water supply continues from the agitation water level B to a water level C in a step 108. The water supply during the steps 106 and 108 may be continuous, or a pause may occur between the supply of water in the steps 106 and 108 and during the agitation such that the water supplies are discrete. The water level C may be any desired water level above the water level A, and, in the illustrated embodiment of FIG. 5, may be near the top of the agitator blades 26.

As the water is supplied to the tub 14 to the water level A and, subsequently, to the water level C, the water fills the tub 14 and is absorbed by the laundry load in the drum 18. When the supplied water reaches the water level A, the laundry load in the drum 18 may have absorbed an amount of water approaching or near a maximum limit of absorption for the laundry load, and full or complete saturation occurs at or before the supplied water reaches the water level C. Thus, the water level C may be referred to as a saturate water level. Most of the saturation of the laundry load may occur by the water level A, but some absorption may still take place between the water levels A and C. As the supplied water passes the water level A and approaches the water level C, the smaller laundry load size may begin to float while the supply of water (when the water is supplied directly onto the laundry load) compresses the laundry load into the water. Thus, during this period of water supply between the water level A and the water level C, some water may be absorbed by the laundry load while most of the water fills the tub 14 with free water. When the actual water level reaches the water level C, most of the interstitial spaces have been filled, if the load is fully immersed in wash liquid. Because most of the saturation of the laundry load occurs before the water level A, displacement of the water caused by the laundry load, or the amount of free water, dominates in the amount of water required to reach the water level C from the water level A even though some absorption still occurs between the water levels A and C. As discussed above, this initial stage of water supply where the supplied water is partially absorbed by the laundry load and partially becomes free water in the tub 14 can be used to determine load size for extreme laundry loads, i.e., relative extremes on a load size scale, which may occur at a step 110 in the method 100.

At the step 110, a first qualitative load size may be determined. The first qualitative load size references a first determination. In some cases, a first qualitative load size involves selecting between different qualitative load sizes. For example, in the method 100, the first qualitative load size may include an extra small load size, a small load size, and an extra large load size because these qualitative load sizes may be determined or ruled out depending on the amount of water supplied between the water levels A and C, which may be referred to as a water amount A-C.

The amount of water A-C may be determined from the water flow sensor 52 and, in the case of a rotating wheel flow rate sensor, may be the count of revolutions it took to raise the water level from A to C. Alternatively, the water amount A-C may be manipulated in a desired manner before being employed to determine the load size. For example, the count may be compared to a data table in the controller 60 (FIG. 2) to determine the load size or the count may be input to an algorithm in the controller 60 to determine the load size.

When the first qualitative load size includes the extra small, small, and extra large load sizes, the determination at the step 110 may be made by comparing the water amount A-C to preset and empirically determined extra small, small, and extra large amounts of water, respectively. If the amount of supplied water is greater than the preset extra small amount of water (because smaller loads require more water to reach a given water level assuming that displacement dominates absorbency), then the load size may be determined to be extra small. If the amount of supplied water is less than the preset extra small amount of water and greater than the preset small amount of water, then the load size may be determined to be small. Similarly, if the amount of supplied water is less than the preset small amount of water and less than the preset extra large amount of water, then the load size may be determined to be extra large.

As previously described, load sizes at the extremes of the qualitative load size range can be determined during the initial water supply because of their volume, absorbency and displacement characteristics. For a small load, the time from when the water fill is begun and until the water level sensor senses the presence of water is relatively short because more of the water passes by the laundry and less water is absorbed by the laundry. For a relatively large load, this same time is relatively long because almost no water passes by the laundry and much more water is absorbed. For qualitative load sizes near the extremes, such as the extra small, small and extra large, this time is sufficient to make a qualitative load size determination. This time value may be an actual time another parameter indicative of time, such as the count of a water volume supply meter.

If the laundry load corresponds to the first qualitative load size, then at a step 112, water may be supplied to an operational water level corresponding to the laundry load size, if the water level has not already achieved the operational water level. An operational water level may be a level corresponding to the volume of water used in the wash or other operational process for the determined load size. As an example, in one embodiment, an extra small load of about less than 1 pound may have an operational water level corresponding to about 10 gallons of water, a small load of about between 1 and 5 pounds may have an operational water level corresponding to about 11 gallons of water, and an extra large load of about greater than 15 pounds may have an operational water level corresponding to about 22 gallons of water. All exemplary load sizes provided herein have a fabric type of about 50% cotton and 50% polyester for exemplary purposes.

The steps in the method 100 described thus far have been employed to determine load size prior to complete saturation of the laundry load, and the steps yet to be described may be used to determine load size following complete saturation of the laundry load during water supply. In addition to the laundry load being completely saturated at the water level C, the laundry load may also be submerged at the water level C. As used herein, "submerge" means that substantially all of the fabric items in the laundry load may be positioned below the top of the water and it may also be permissible that some of the fabric items, while being positioned below the top of the water, may partially project or extend above the top of the water. Thus, because the laundry load is submerged and completely saturated at the water level C, additional water supplied after the saturation goes to filling the space in the tub 14 and the drum 18 except for the physical space occupied by the laundry load.

If the laundry load does not correspond to the first qualitative load size at the step 110 because the water amount A-C is greater than the preset extra large amount of water but less than the preset small amount of water, then at a step 114, water is supplied to a water level D above the water level C. The water supply during the steps 108 and 114 may be continuous, or a pause may occur between the supply of water in the steps 108 and 114 such that the water supplies are discrete. The water level D may be any desirable water level above the water level C, and, in the illustrated embodiment of FIG. 5, may be along the central shaft 24 where the agitator blades 26 begin to extend outward from the central shaft 24.

During the supply of water from the water level C to the water level D, the saturated laundry load displaces the water. As described above, the density of the laundry load in the mixture of the laundry load and water between the water levels C and D is dependent on the load size. Because the laundry is already saturated, the amount of water supplied between the water levels C and D, which may be referred to as water amount C-D, is a heavy function of load size with fabric type having little or no significance. Thus, the water amount C-D may be used to determine load size.

In particular, the water amount C-D may be employed to determine whether the laundry load corresponds to a second qualitative load size at a step 116. The second qualitative load size references a second determination. In one embodiment, for example, the water amount C-D may be employed to determine a displacement value of the laundry load, and the load size may be determined, in turn, based on the displacement value. The displacement value may be any value related to the displacement caused by the laundry load and may simply be the water amount C-D, in which case, the load size may be determined directly from the water amount C-D. The amount of water C-D may be determined from the water flow sensor 52 (FIG. 2) and, in the case of a rotating wheel flow rate sensor, may be the count of revolutions it took to raise the water level from C to D. Alternatively, the water amount C-D may be manipulated in a desired manner to obtain the displacement value, which may then be employed to determine the load size. For example, the count may be compared to a data table in the controller 60 (FIG. 2) to determine the load size or the count may be input to an algorithm in the controller 60 to determine the load size. As an example, the water amount C-D may be compared to a volume of the tub 14 between the water level C and the water level D, which may be referred to as volume C-D. Because the volume C-D is fixed for a given washing machine and assuming that absorption is negligible (due to the laundry load being saturated by the water level C), the difference between the volume C-D and the water amount C-D may be a volume attributable to the volume of the laundry load. The difference volume, or displacement value, may then be employed to determine the load size.

The second qualitative load size may be any suitable load size, and, continuing the example given above where the first qualitative load size includes the extra small, small, and extra large load sizes, the second qualitative load size may be a medium load size. When the second qualitative load size is the medium load size, the determination at the step 116 may be made by comparing the water amount C-D to a predetermined and/or empirically determined amount of water, such as a preset medium amount of water. If the water amount C-D is greater than the predetermined amount of water (because smaller loads require more water to reach a given level), then the load size may be determined to be medium or at least larger than the small load size.

With continued reference to FIG. 4A if the laundry load corresponds to the second qualitative load size, then at a step 118, water may be supplied to an operational water level corresponding to the laundry load size, if the water level has not already achieved the operational water level. As an example, in one embodiment, a medium load of about 5-11 pounds may have an operational water level corresponding to about 15 gallons of water.

If the laundry load does not correspond to the second qualitative load size at the step 116 because the water amount C-D is less than the predetermined amount of water (i.e., the preset medium amount of water), then at a step 120 (FIG. 4B), water is supplied to a water level E above the water level D. The water supply during the steps 114 and 120 (FIG. 4B) may be continuous, or a pause may occur between the supply of water in the steps 114 and 120 (FIG. 4B) such that the water supplies are discrete. The water level E may be any desirable water level above the water level D, and, in the illustrated embodiment of FIG. 5, may be along the central shaft 24 at a position higher than the water level D.

Referring to FIG. 4B, similar to the water amount C-D, the water amount supplied between the water levels D and E, which may be referred to as a water amount D-E, may be used to determine load size. In particular, the water amount D-E may be employed to determine whether the laundry load corresponds to a third qualitative load size at a step 122. The third qualitative load size references a third determination. In one embodiment, for example, the water amount D-E may be employed to determine a displacement value of the laundry load, and the load size may be determined, in turn, based on the displacement value. The displacement value may be any value related to the displacement caused by the laundry load and may simply be the water amount D-E, in which case, the load size may be determined directly from the water amount D-E. The amount of water D-E may be determined from the water flow sensor 52 (FIG. 2) and, in the case of a rotating wheel flow rate sensor, may be the count of revolutions it took to raise the water level from D to E. Alternatively, the water amount D-E may be manipulated in a desired manner to obtain the displacement value, which may then be employed to determine the load size. For example, the count may be compared to a data table in the controller 60 (FIG. 2) to determine the load size or the count may be input to an algorithm in the controller 60 to determine the load size. As an example, the water amount D-E may be compared to a volume of the tub 14 between the water level D and the water level E, which may be referred to as volume D-E. Because the volume D-E is fixed for a given washing machine and assuming that absorption is negligible (due to the laundry load being saturated by the water level C), the difference between the volume D-E and the water amount D-E may be a volume attributable to the volume of the laundry load. The difference volume, or displacement value, may then be employed to determine the load size.

The third qualitative load size may be any suitable load size, and, continuing the example given above, the third qualitative load size may be a large load size. When the third qualitative load size is the large load size, the determination at the step 122 may be made by comparing the water amount D-E to a predetermined and/or empirically determined amount of water, such as a preset large amount of water. If the water amount D-E is greater than the predetermined amount of water (because smaller loads require more water to reach a given level), then the load size may be determined to be large or at least larger than the medium load size.

With continued reference to FIG. 4B, if the laundry load corresponds to the third qualitative load size, then at a step 124, water may be supplied to an operational water level corresponding to the laundry load size, if the water level has not already achieved the operational water level. As an example, in one embodiment, a large load of about 11-15 pounds may have an operational water level corresponding to about 18 gallons of water.

On the other hand, if the laundry load does not correspond to the third qualitative load size, such that, in the given example, the water amount D-E is less than the predetermined amount of water (i.e., preset large amount of water), then at a step 126, the laundry load may be determined to be a fourth qualitative load size. The fourth qualitative load size may be any suitable load size, and, continuing the example given above, the fourth qualitative load size may be an extra large load size. While the fourth qualitative load size may reference a fourth determination, the extra large load size may alternatively be considered part of the third qualitative load size and the third determination wherein the load size is determined to be large or extra large based on the water amount D-E in the step 122.

The determination of the extra large load size in the step 126 (i.e., the fourth determination) differs from the determination of the extra large load size in the step 110 (i.e., the first determination) in that the fourth determination identifies extra large load sizes for laundry loads having differing absorbency than the extra large load sizes identified in the first determination. The third and fourth determinations, which, as stated above, may be described as the same determination, may facilitate differentiating between large laundry loads and extra large laundry loads that were not identified as such from the first determination.

Following the determination of the fourth qualitative load size in the step 126, water may be supplied to an operational water level corresponding to the laundry load size at a step 128, if the water level has not already achieved the operational water level.

After determination of the load size in one of the steps 110, 116, 122, and 126 and supply of water to the corresponding operational water level during one of the steps 102, 118, 124, and 128, the process associated with the method 100 may begin or continue in any desired manner in a step 130.

Figure 7:
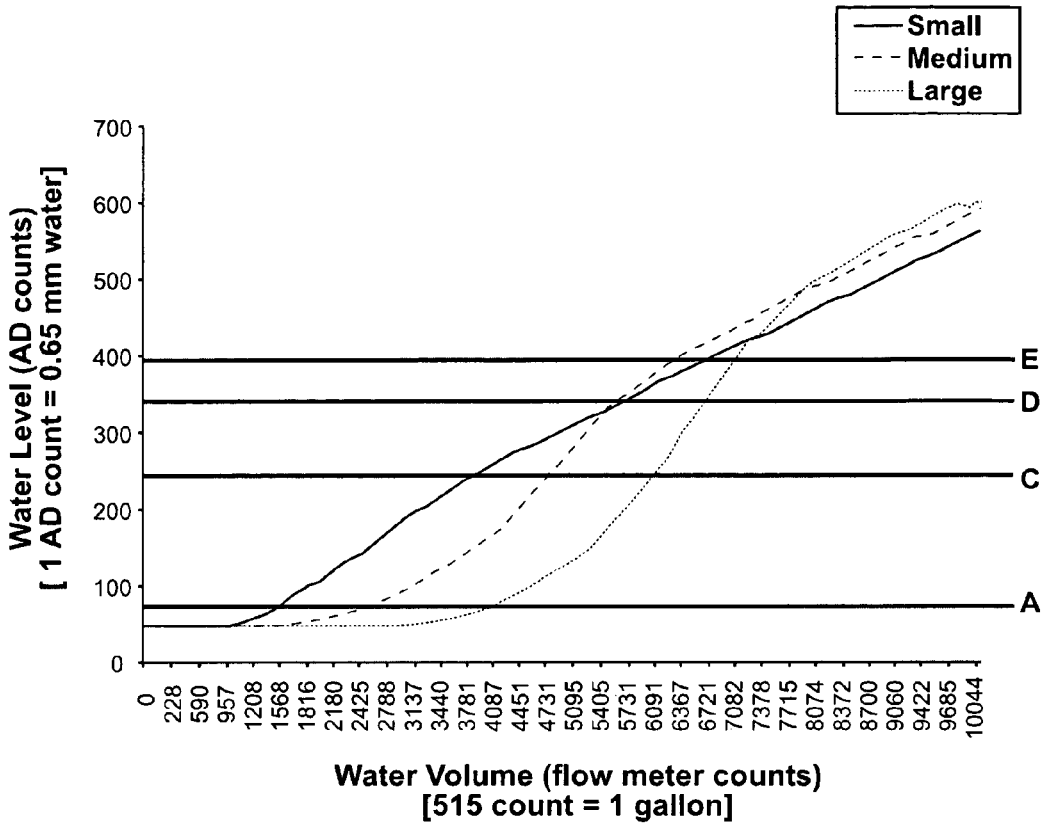
FIG. 7 is a graph of water level as a function of water volume during water supply to the exemplary water levels A, C, D, and E for small, medium, and large size laundry loads according to the method of FIGS. 4A and 4B applied to the washing machine of FIG. 1.
Figure 8:
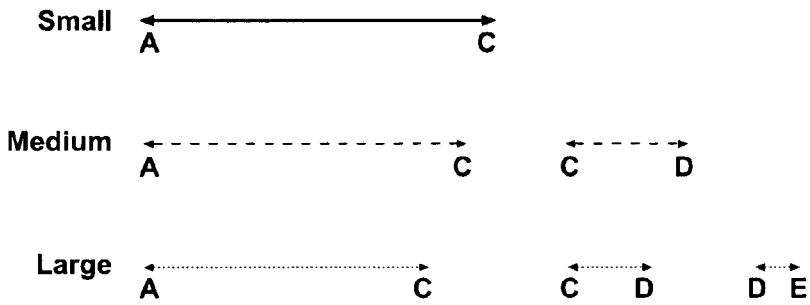
FIG. 8 is a line graph of the amount of water supplied between the water levels A and C, the water levels C and D, and the water levels D and E, where appropriate, for the small, medium, and large size loads taken from the graph of FIG. 7.

FIGS. 7 and 8 provide an example of data employed to make the first, second, and third determinations according to one embodiment of the invention. FIG. 7 is a graph of water level as a function of water volume or amount of supplied water for small, medium, and large laundry loads. The amounts of water required to reach the water levels A, C, D, and E in the graph of FIG. 7 are drawn to scale in FIG. 8 adjacent one another for ease of comparison. As can be seen in FIG. 8, at the first determination based on the water amount A-C, the small load has a greater water amount A-C than the medium and large loads. Similarly, at the second determination based on the water amount C-D, the medium load has a greater water amount C-D than the large load, which may be identified at the third determination using the water amount D-E.

In general, the method 100 involves supplying water to predetermined water levels and determining the amount of water supplied to reach each predetermined water level. The water levels can be considered to define a water level window defined by lower and upper water levels. For example, as shown in FIG. 5, the water levels A and C may define a water level window A-C, the water levels C and D may define a water level window C-D, and the water levels D and E may define a water level window D-E. The lower water levels in these exemplary water level windows are A, C, and D, respectively, and the upper water levels are C, D, and E, respectively. If the load size is not determined at the first determination based on the water amount A-C in the water level window A-C, then the water level window may shift upward, or a new water level window may be defined. In the given example, the shifted or new water level window may be the water level window C-D. The shifted or new water level window may utilize the upper water level of the previous water level window as a new lower water level (e.g., the upper water level C in the water level window A-C becoming the new lower water level C in the new water level window C-D), or the new lower water level may be a different water level. If the load size is not determined at the second determination based on the water amount C-D in the water level window C-D, then the water level window may shift upward, or a new water level window may be defined, such as the water level window D-E, and so on. This process may repeat until the load size is determined.

Further, the amount of water supplied to fill each water level window may be considered an indicator of the relative density of the mixture of the laundry load and water in the respective water level window. As discussed above, smaller laundry loads require more water to fill a given water level window; thus, the relative density of the mixture may be indicated by the amount of water supplied to fill the given water level window.

Optionally, the amounts of water supplied to reach the various levels in the tub 14 (FIG. 5) may be employed to determine fabric type in addition to determining load size. In general, comparison between amounts of water indicative of the absorption and displacement characteristics of the fabric items in the laundry load may be used to determine the fabric type. In one embodiment, after the load size has been determined, a ratio may be calculated as an inference of fabric type. As examples, the ratio, difference, and/or weighting of combinations of amounts of water supplied to reach the water levels A, C, D, and E may provide the information of the load type. Examples include (water amount A-C/water amount C-D) or ((amount of water supplied to reach water level E/amount of water supplied to reach water level A)—(amount of water supplied to reach water level E—amount of water supplied to reach water level D)). A higher ratio corresponds to a more absorbent fabric type, such as a fabric type having a relatively higher cotton content as compared to polyester or other synthetic fabric content. Other ratios and other calculations, such as differences, and combinations thereof may be used to infer the fabric type.

The water levels S, A, B, C, D, and E are not limited to the particular levels illustrated in FIG. 5, and the levels shown in FIG. 5 are provided for illustrative and exemplary purposes. The water levels may vary for differing washing machines and may vary depending on the type of water supply system employed in a particular washing machine. For example, the water levels may vary depending on whether the water supply system is a spray-type system as described above (and depending on the type of spray system), a waterfall-type system where the water pours onto the laundry load, a system where the water is supplied directly to the sump 16, or other type of water supply system. Further, the water levels may vary depending on other operational factors, such as whether the drum 18 rotates during the water supply to facilitate distribution of the water on the laundry load.

Selection of the upper and lower water levels to define a given water level window may be selected based on anecdotal or test data and correspond to levels where it is expected that the data is sufficient to differentiate between the different load sizes. It is also possible to select the spacing of the upper and lower water levels to define the water level window without regard for which levels are more likely to show differentiating data. The upper and lower water levels from one water level window to another may be spaced differently (i.e., different tub volumes defined by the water level windows) or consistently (i.e., equal tub volumes defined by the water level windows).

In the method 100, the operational water level may be set without a corresponding inference or determination of load size and vice-versa. It is possible that the method 100 may be employed only for setting the operational water level, in which case the inference of the load size may not be necessary. For example, in the steps 110, 116, 122, and 126 of the exemplary method in FIGS. 4A and 4B, a determination of operational water level may be made instead of a determination of a qualitative load size, with a subsequent fill to the operational water level in the steps 112, 118, 124, and 128. It is also contemplated that the method 100 may be employed for only determining the load size, and the inferred load size may thereafter be employed to determine other parameters for the operation cycle. It is also contemplated for the method 100 to both infer the load size and set the operational water level.

When the method 100 is employed for determining load size, the inferred load size may be a qualitative load size wherein the laundry load is assigned to a category, such as small, medium, and large, of load size based on the qualities of the laundry load. That is, the size of the load need not be weighed or otherwise directly measured to obtain a quantitative or numerical measurement. While the qualitative load size may not correlate with a direct numerical measurement of the weight or volume of the laundry load, an estimated or empirical weight or weight range may be associated to the qualitative load size (e.g., a small load size may be described as a 1-5 pound load size).

The method 100 may be adapted for determining more or less than four qualitative load sizes having the five load sizes extra small, small, medium, large, and extra large, and, similarly, setting more or less than the corresponding number of operational water levels. In one example, water may be supplied to additional levels above the water level E, and the water levels may be closer together for greater resolution, which may also enable more load sizes and operational water levels. As an example, water levels F and G and corresponding water amounts E-F and F-G may be used to determine additional load sizes and operational water levels.

The method 100 may be adapted for use with different washing machines. Various aspects, such as the number of load sizes and operational water levels, may depend on the configuration of the washing machine 10 and the external water supply. The method 100 may also be combined with a flow meter, flow restrictor, alternate fill method, and/or inputs by the user, such as fabric type.

The above description and the figures refer to the supply of water to the tub 14. The water may be water alone or water in combination with an additive, such as a wash aid, including, but not limited to a detergent, a bleach, an oxidizer, a fabric softener, etc. Any additive supplied to the tub 14, either through a detergent dispenser or manually added directly into the drum 18 or the tub 14, may affect the output of the water level sensor 54, and the method 100 may be adapted to account for such effects.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for determining laundry load size in an automatic clothes washer having a laundry chamber for receiving the laundry load for treatment according to a cycle of operation, a water level sensor associated with the laundry chamber for detecting a water level in the laundry chamber, and a controller for controlling the clothes washer according to the cycle of operation, the method comprising:

supplying water to a saturate water level in the laundry chamber sufficient to saturate the laundry load;

supplying water to a plurality of predetermined water levels higher than the saturate water level subsequent to saturating the laundry load;

determining by the controller an amount of water supplied to reach each of the plurality of predetermined water levels from a prior water level; and determining a load size by the controller based on the determined amount of water supplied between at least one of the plurality of predetermined water levels and the prior water level.

2. The method according to claim 1 wherein the supplying water to the plurality of predetermined water levels ceases when the load size can be determined based on the determined amount of water supplied between one of the plurality of predetermined water levels and the prior water level.

3. The method according to claim 2 wherein the load size can be determined when the determined amount of water supplied between one of the plurality of predetermined water levels and the prior water level satisfies a predetermined relationship with respect to a predetermined amount of water.

4. The method according to claim 1, further comprising supplying water to an operational water level corresponding to the determined load size after determination of the load size.

5. The method according to claim 1 wherein the saturate water level is sufficient to submerge the laundry.

6. The method according to claim 5 wherein the determining the load size comprises determining whether the laundry load is a first load size based on the determined amount of water supplied between a first of the plurality of predetermined water levels and the saturate water level.

7. The method according to claim 6 wherein the determining the load size further comprises, when the laundry load is not the first load size, determining whether the laundry load is a second load size based on the determined amount of water supplied between a second of the plurality of predetermined water levels and the first of the plurality of predetermined water levels.

8. The method according to claim 7, further comprising supplying water to an initial water level before the supplying of water to the saturate water level and determining whether the laundry load is a third load size based on an amount of water supplied between the initial and saturate water levels after the supplying of water to the saturate water level.

9. The method according to claim 8 wherein the laundry load is determined to be the first load size when the determined amount of water supplied between the first of the plurality of predetermined water levels and the saturate water level is less than a predetermined first amount and greater than a predetermined second amount.

10. The method according to claim 9 wherein the laundry load is determined to be the second load size when the determined amount of water supplied between the second of the plurality of predetermined water levels and the first plurality of predetermined water levels is less than the predetermined second amount and greater than a predetermined third amount.

11. The method according to claim 10 wherein the laundry load is determined to be the third load size when the amount of water supplied between the initial and saturate water levels is greater than the predetermined first amount or less than a predetermined fourth amount that is less than the predetermined third amount.

12. The method according to claim 8 wherein the determining whether the laundry load is a third load size comprises determining whether the laundry load is one of an extra small, small, and extra large load size.

13. The method according to claim 12 wherein the determining whether the laundry load is a first load size comprises determining whether the laundry load is a medium load size, and the determining whether the laundry load is a second load size comprises determining whether the laundry load is a large load size.

14. The method according to claim 13 wherein the laundry load is determined to be extra small when the amount of water supplied between the initial and saturate water levels is greater than a predetermined extra small amount of water, the laundry load is determined be small when the amount of water supplied between the initial and saturate water levels is less than the predetermined extra small amount of water and greater than a predetermined small amount of water, and the laundry load is determined to be extra large when the amount of water supplied between the initial and saturate water levels is less than a predetermined extra large amount of water.

15. The method according to claim 14 wherein the laundry load is determined to be medium when the determined amount of water supplied between the first of the predetermined water levels and the saturate water level is less than the predetermined small amount of water and greater than a predetermined medium amount of water, and the laundry load is determined to be large when the determined amount of water supplied between the second of the predetermined water levels and the first predetermined water level is less than the predetermined medium amount of water and greater than a predetermined large amount of water that is greater than the predetermined extra large amount of water.

16. The method according to claim 1, further comprising supplying water to an initial water level before the supplying of water to the saturate water level and determining whether the laundry load is a first load size based on an amount of water supplied between the initial and saturate water levels after the supplying of water to the saturate water level.

17. The method according to claim 1 wherein the load size is a qualitative load size.

18. The method according to claim 1 wherein the supplying of the water to the saturate water level and to a first of the plurality of predetermined water levels is continuous.

19. The method according to claim 1 wherein the supplying of the water between the predetermined water levels is continuous.

20. A method for determining laundry load size in an automatic clothes washer having a laundry chamber for receiving the laundry load for treatment according to a cycle of operation, a water level sensor associated with the laundry chamber for detecting a water level in the laundry chamber, and a controller for controlling the clothes washer according to the cycle of operation, the method comprising:

supplying water to a saturate water level in the laundry chamber sufficient to saturate the laundry load;

supplying water to the laundry chamber from the saturate water level to a first water level above the saturate water level subsequent to saturating the laundry load to define a first amount of water;

determining by the controller whether the laundry load corresponds to a first load size based on the first amount of water;

supplying water to the laundry chamber from the first water level to a second water level, above the first water level, to define a second amount of water when the laundry load does not correspond to the first load size; and determining by the controller whether the laundry load corresponds to a second load size based on the second amount of water.

21. The method according to claim 20 wherein the laundry load is determined to be the first load size when the first amount of water is less than a predetermined first water amount and greater than a predetermined second water amount.

22. The method according to claim 21 wherein the laundry load is determined to be the second load size when the second amount of water is less than the predetermined second water amount and greater than a predetermined third water amount.

23. The method according to claim 20, further comprising supplying water to an operational water level corresponding to the determined load size after determination of the load size.

24. The method according to claim 20 wherein the saturate water level is sufficient to submerge the laundry.

25. The method according to claim 24, further comprising supplying water to an initial water level before the supplying of water to the saturate water level, determining a third amount of water supplied between the initial and saturate water levels, and determining whether the laundry load is a third load size based on the third amount of water.

26. The method according to claim 25 wherein the laundry load is determined to be the third load size when the third amount of water is greater than a predetermined first water amount or less than a predetermined second water amount.

27. The method according to claim 26 wherein the determining whether the laundry load is a third load size comprises determining whether the laundry load is one of an extra small, small, and extra large load size.

28. The method according to claim 27 wherein the determining whether the laundry load is a first load size comprises determining whether the laundry load is a medium load size, and the determining whether the laundry load is a second load size comprises determining whether the laundry load is a large load size.

29. The method according to claim 28 wherein the laundry load is determined to be extra small when the third amount of water is greater than a predetermined extra small amount of water, the laundry load is determined be small when the third amount of water is less than the predetermined extra small amount of water and greater than a predetermined small amount of water, and the laundry load is determined to be extra large when the third amount of water is less than a predetermined extra large amount of water.

30. The method according to claim 29 wherein the laundry load is determined to be medium when the first amount of water is less than the predetermined small amount of water and greater than a predetermined medium amount of water, and the laundry load is determined to be large when the second amount of water is less than the predetermined medium amount of water and greater than a predetermined large amount of water that is greater than the predetermined extra large amount of water.

31. The method according to claim 25, further comprising determining a fabric type of the laundry load based on a comparison of the third amount of water and at least one of the first and second amounts of water.

32. The method according to claim 31 wherein the determination of the fabric type comprises determining a ratio of the third amount of water to the second amount of water.

33. The method according to claim 20 wherein the first and second load sizes are qualitative load sizes.

34. The method according to claim 20 wherein the supplying of the water to the saturate water level and to the first water level is continuous.

35. The method according to claim 20 wherein the supplying of the water to the first water level and to the second water level is continuous.

36. A method for determining laundry load size in an automatic clothes washer having a laundry chamber for receiving the laundry load for treatment according to a cycle of operation, a water level sensor associated with the laundry chamber for detecting a water level in the laundry chamber and outputting a signal indicative of the water level, and a controller for controlling the clothes washer according to the cycle of operation, the method comprising:

supplying water to a saturate water level in the laundry chamber sufficient to saturate the laundry load;

supplying water to a plurality of predetermined water levels higher than the saturate water level subsequent to saturating the laundry load;

determining by the controller an amount of water supplied to reach each of the plurality of predetermined water levels from a prior water level based on a signal indicative of the water level output by the water level sensor and received by the controller; and determining a load size by the controller based on the determined amount of water supplied between at least one of the plurality of predetermined water levels and the prior water level;

wherein the controller determines the load size by at least one of comparing the determined amount of water to a data table associated with the controller and inputting the determined amount of water into a load size algorithm associated with the controller.

* * * * *

UNITED STATES PATENT AND TRADEMARK OFFICE

CERTIFICATE OF CORRECTION

PATENT NO. : 8,381,341 B2
APPLICATION NO. : 12/209466
DATED : February 26, 2013
INVENTOR(S) : Nieh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 893 days.

Signed and Sealed this
Eighteenth Day of November, 2014

Michelle K. Lee

Michelle K. Lee
*Deputy Director of the United States Patent and Trademark Office*